US005538419A

United States Patent [19]

Lin

[11] Patent Number: 5,538,419

[45] Date of Patent: Jul. 23, 1996

[54] GAS LIGHTER WITH PIVOTAL CLIP

[76] Inventor: Hung-Chan Lin, c/o Hung Hsing Patent Service Center, P.O. Box 55-1670, Taipei, Taiwan

[21] Appl. No.: 520,098

[22] Filed: Aug. 28, 1995

[51] Int. Cl.[6] ..... F23Q 1/04

[52] U.S. Cl. ..... 431/253; 401/195; 431/343

[58] Field of Search ..... 431/253, 344, 431/277, 276, 144, 254, 255; 401/195, 52; 206/85, 86, 236

[56] References Cited

U.S. PATENT DOCUMENTS

| | | | |
|---|---|---|---|
| 1,342,838 | 6/1920 | Aronson | 431/253 |
| 3,150,507 | 9/1964 | Smith | 431/253 |
| 3,484,178 | 12/1969 | Weissmann | 431/343 |
| 4,384,799 | 5/1983 | Shklovsky | 401/195 |
| 5,346,392 | 9/1994 | Kim | 431/277 |
| 5,454,657 | 10/1995 | Kim | 431/253 |

FOREIGN PATENT DOCUMENTS

| | | | |
|---|---|---|---|
| 806411 | 3/1951 | Germany | 431/253 |

*Primary Examiner*—James C. Yeung

[57] ABSTRACT

A gas lighter includes: a clip member pivotally secured on an upper portion of a lighter body having a cross section generally elliptical shaped, with the clip member foldably received on a convex side wall disposed on an end portion of a transverse axis of the lighter body for a smooth holding of the lighter for ergonomic ignition use; and upon a pivotal movement of the clip member on the lighter body to be positioned beyond a flat side wall disposed on an end portion of a conjugate axis of the lighter body, the clip member can be clamped on a user pocket for a convenient storages.

10 Claims, 5 Drawing Sheets

GAS LIGHTER WITH PIVOTAL CLIP

BACKGROUND OF THE INVENTION

A gas lighter can be used for igniting a cigarette for smoking purpose. However, a conventional gas lighter is always kept inside a user's pocket or brief case. When it is intented to use the lighter, the gas lighter should be taken out from the pocket or case to easily cause inconvenience for the user.

Even though the gas lighter may be integrally formed with a fixed clip on the lighter body to clamp the gas lighter on a user's pocket for an instant ignition use, the fixed type clip should be protruded outwardly from the lighter body to influence a smooth and ergonomic holding of the lighter when depressing the lever for igniting purpose. Moreover, the clip fixedly formed on the gas lighter may increase the production cost, thereby influencing its mass production.

SUMMARY OF THE INVENTION

The object of the present invention is to provide a gas lighter including: a clip member pivotally secured on an upper portion of a lighter body having a cross section generally elliptical shaped, with the clip member foldably received on a convex side wall disposed on an end portion of a transverse axis of the lighter body for a smooth holding of the lighter for ergonomic ignition use; and upon a pivotal movement of the clip member on the lighter body to be positioned beyond a flat side wall disposed on an end portion of a conjugate axis of the lighter body, the clip member can be clamped on a user pocket for a convenient storage.

DETAILED DESCRIPTION

Figure 1:
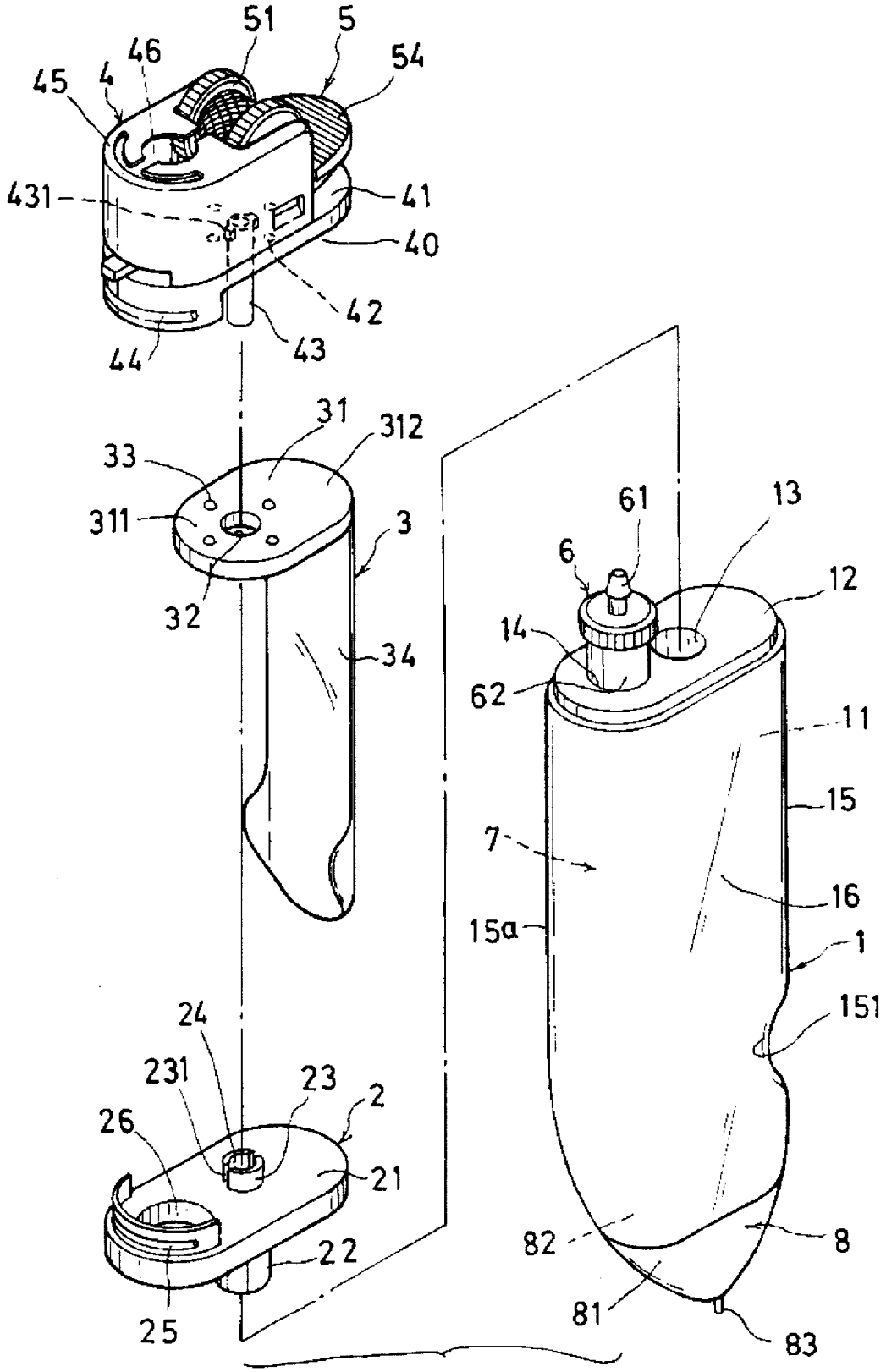
FIG. 1 is an illustration showing all elements in construction of the present invention.
Figure 2:
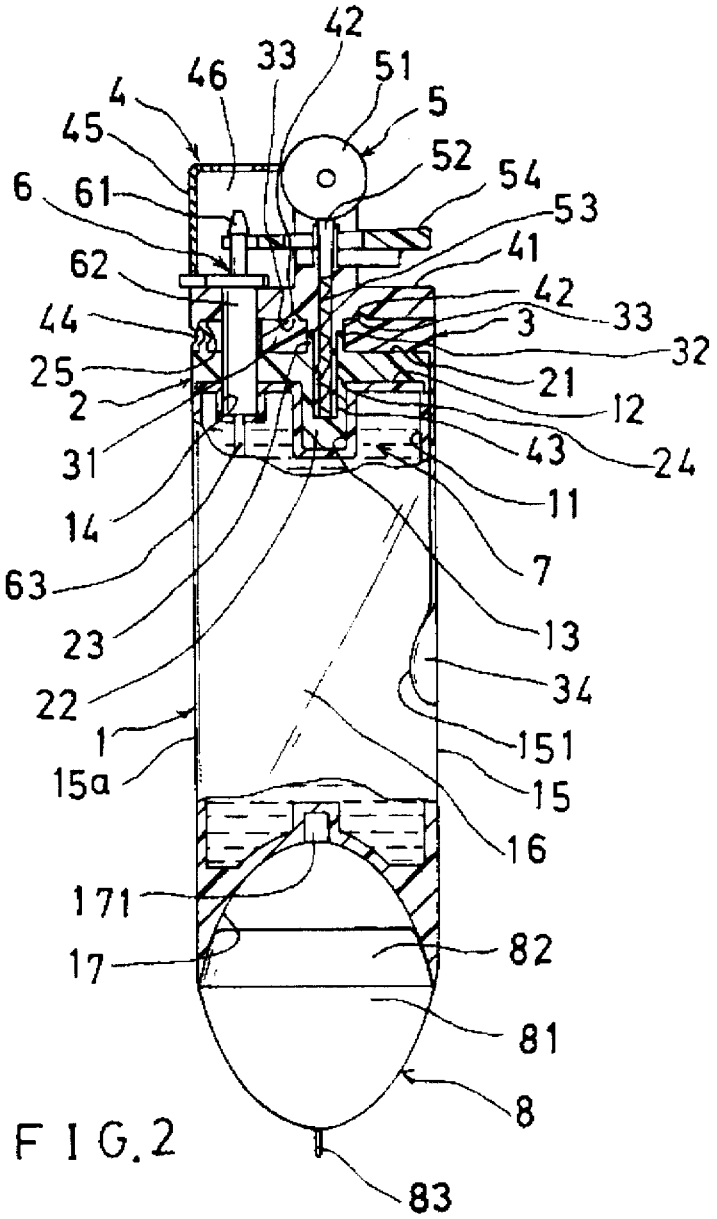
FIG. 2 is a longitudinal sectional drawing of the present invention.

As shown in FIGS. 1–7, the present invention comprises: a lighter body 1 for filling fuel 7 therein, a packing member 2, a clip member 3, a top frame 4, an igniting means 5, a valve means 6, and a pen means 8 detachably secured in a bottom portion of the lighter body 1.

The lighter body 1 includes: a fuel container 11 having a cross section generally formed as elliptical or oval shape (or other suitable shapes) defining a transverse axis la and a conjugate axis 1*b;* a first and a second convex side wall 15, 15*a* disposed on two opposite ends of the transverse axis la; two flat side walls 16, 16 disposed on two opposite ends of the conjugate axis 1*b;* an upper cover 12 formed on an upper portion of the container 11 having a stem opening 13 recessed in a middle portion of the upper cover 12 for engaging the packing member 2; and a valve opening 14 formed in an end portion of upper cover 12 adjacent to the second convex side wall 15*a* for securing the valve means 6 therein.

The packing member 2 includes: a base plate 21 generally formed as an elliptical shape coincided with the cross section of the fuel container 11 of the lighter body 1, a hollow stem 22 protruding downwardly from the base plate 21 and engaged with the stem opening 13 recessed in the upper cover 12 of the lighter body 1, a shaft portion 23 protruding upwardly from the base plate 21 for rotatably mounting the clip member 3 and having a central opening 24 recessed in the shaft portion 23 for engaging the top frame 4 with the shaft portion 23 aligned with the hollow stem 22, a receiving extension 25 protruding upwardly from an edge portion of the base plate 21 adjacent to the second convex side wall 15*a* of the lighter body 1, and a valve opening 26 formed through the base plate 21 adjacent to the receiving extension 25 and distal from the first convex side wall 15 of the lighter body 1 for passing the valve means 6 through the valve opening 26.

The clip member 3 includes: a rotating disk 31 generally formed as an elliptical shape and having an inner end portion 311 adjacent to the valve means 6 which is secured in the packing member 2 and protruded upwardly into the top frame 4, a shaft hole 32 formed in the inner end portion 311 of the disk 31 and engaged with the shaft portion 23 of the packing member 2, and a clip portion 34 protruding downwardly from the outer end portion 312 of the disk 31 and normally rested on the first convex side wall 15 of the lighter body 1 to be engageable with a clip socket 151 recessed in the first convex side wall 15 for forming a smooth arcuate outer surface of the clip portion 34 and the first convex side wall 15 of the lighter body 1.

The top frame 4 includes: a platform 41 formed as an elliptical shape to be projectively coincided with the packing member 2 and the upper cover 12 of the lighter body 1, a flint pipe 43 protruding downwardly from the platform 41 to be filled with a flint 52 of the igniting means 5 in the flint pipe 52 and engaged with the central opening 24 recessed in the packing member 2, an engaging extension 44 protruding downwardly from an edge portion of the platform 41 to be coupled with the receiving extension 25 formed on the packing member 2 (the engaging extension 44 may be formed with convex portion to be engaged with a concave portion recessed in the receiving extension 25), a wind shield 45 protruding upwardly from the platform 41 for surrounding a gas nozzle 61 of the valve means 6 fixed in an ignition chamber 46 defined within the wind shield 45, and a rotating space 40 defined between a bottom surface of the platform 41 and the base plate 21 of the packing member 2 for rotatably mounting the rotating disk 31 of the clip member 3 within the rotating space 40.

The platform 41 of the top frame 4 is formed with a plurality of recesses 42 annularly disposed around the flint pipe 43 on a bottom surface of the platform 41 to be engageable with a plurality of protrusions 33 annularly disposed around the shaft hole 32 in the rotating disk 31 of the clip member 3 for stably engaging the clip member 3 with the top frame 4 when pivoting the clip member 3 about the shaft portion 23 (FIGS. 4, 5) of the packing member 2 on the lighter body 1.

The flint pipe 43 is formed with two lugs 431 engageable with a pair of slots 231 diametrically slotted on the shaft portion 23 for preventing a twisting or slipping of the pipe 43 in the central opening 24 of the shaft portion 23.

The igniting means 5 is a conventional ignition mechanism having a striker wheel 51 rotatably mounted on the top frame 4, the flint 52 retained on a tension spring 53 filled in the flint pipe 43, and an actuating lever 54 pivotally mounted on the top frame 4 to be depressed for biasing and opening the gas nozzle 61 of the valve means 6 including a gas pipe 62 passing through the platform 41 and the packing member 2, and a suction tube 63 inserted into the fuel container 11 of the lighter body 1 for sucking fuel 7 through the tube 63 and the pipe 62 connected with the tube 63 to be ignited by the igniting means 5.

The lighter body 1 has a bottom cavity 17 recessed in a bottom of the lighter body 1 for receiving a pen means 8 in the bottom cavity 17 and also for holding the pen means 8 for writing purpose.

Figure 6:
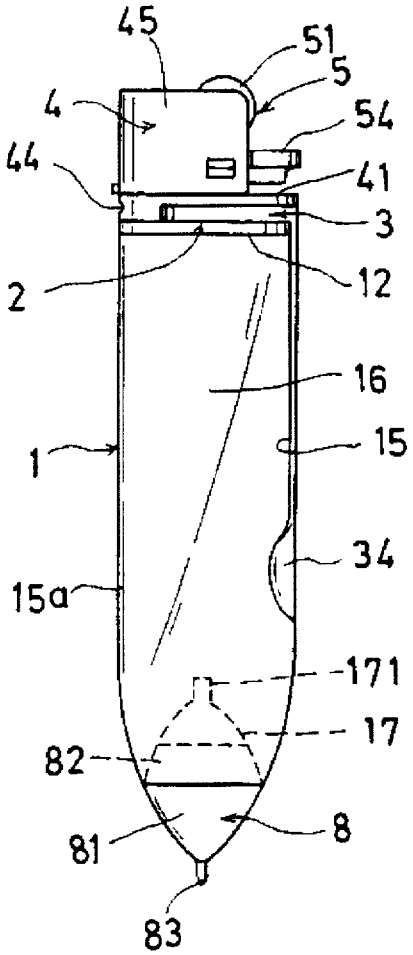
FIG. 6 is an illustration showing a pen means held on a bottom of the gas lighter.
Figure 7:
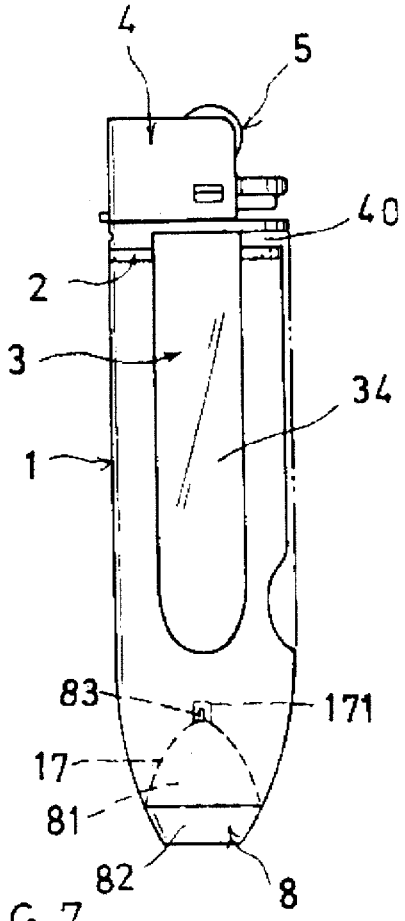
FIG. 7 is an illustration showing the pen folded into the bottom of the lighter.

The pen means 8 includes: a writing portion 83 fixed on a holding portion 81 generally formed as a cone shape and engageable with the bottom cavity 17 formed as a cone shape concave and tapered upwardly in the lighter body 1 when receiving and storing the pen means 8 in the bottom cavity 17 which is formed with a tip socket 171 recessed upwardly at a central inner portion of the cavity 17 for receiving the writing portion 83 (FIG. 7) which may be a ballpoint of a ball pen or a lead of a pencil, not limited in this invention, and a truncated base 82 generally formed as a short truncated cone shape tapered in a direction opposite to a tapering direction of the holding portion 81 and engageable with the bottom cavity 17 for stably embedding the truncated base 82 in the bottom cavity 17 for protruding the holding portion 81 and the writing portion 83 downwardly for writing purpose as shown in FIG. 6.

Figure 8:
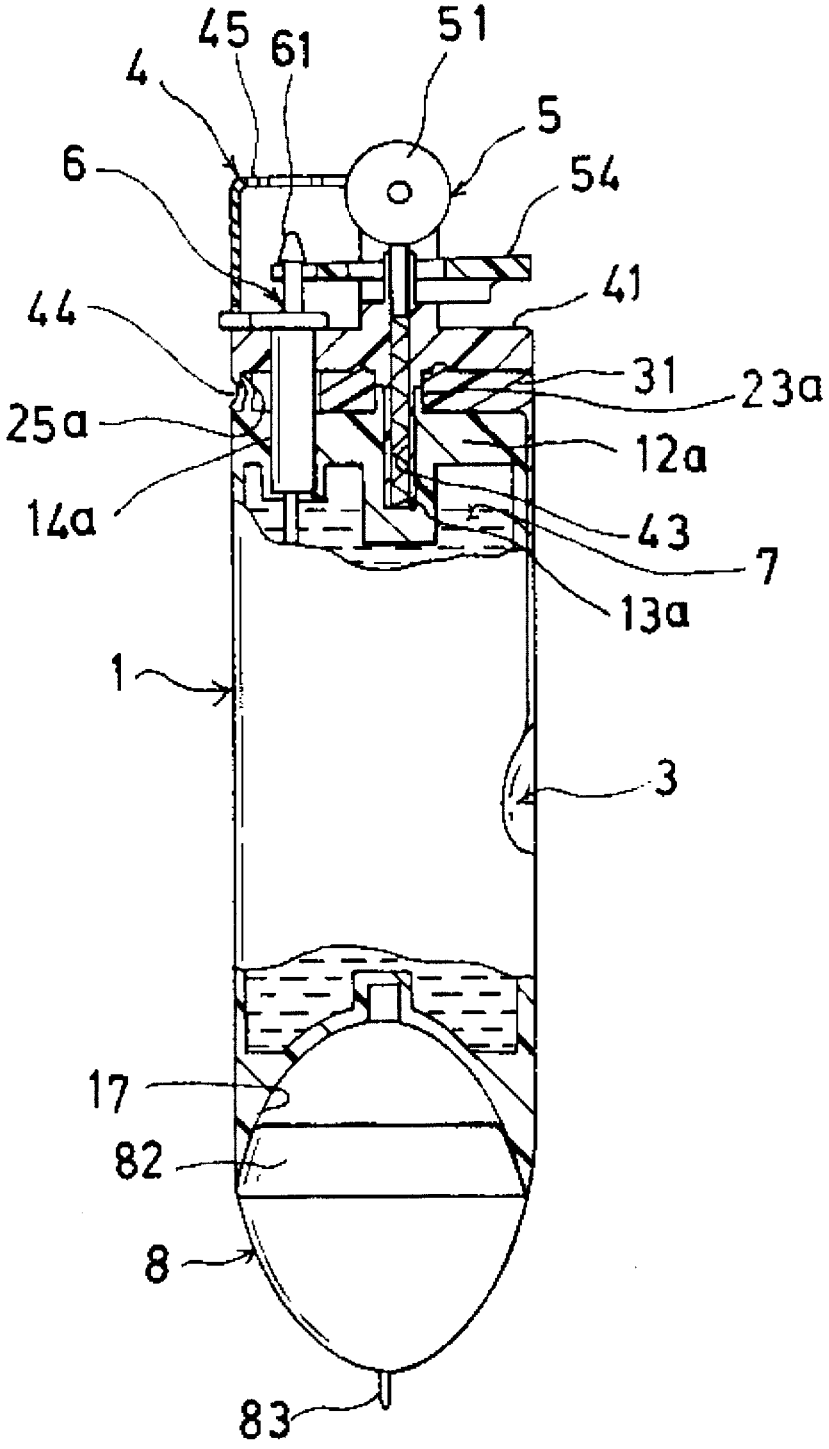
FIG. 8 is a longitudinal sectional drawing of another preferred embodiment of the present invention.

The present invention may be modified as shown in FIG. 8, in which the aforementioned packing member 2 is omitted and the structure of the aforesaid packing member 2 may be integrally combined to the upper cover **12*a* to have the shaft portion 23*a* and the receiving extension 25*a* directly protruding upwardly from the upper cover 12*a* for respectively engaging the flint pipe 43 and the engaging extension 44 of the top frame 4 to directly mount the top frame 4 on the upper cover 12*a* of the lighter body 1 for pivotally securing the clip member 3 between the top frame 4 and the upper cover 12*a* of the lighter body 1**.

The present invention may be modified without departing from the spirit and scope of this invention. The shapes of the elements of the gas lighter and the pivoting mechanism for rotatably mounting the clip member 3 on the gas lighter are not limited in this invention.

Figure 4:
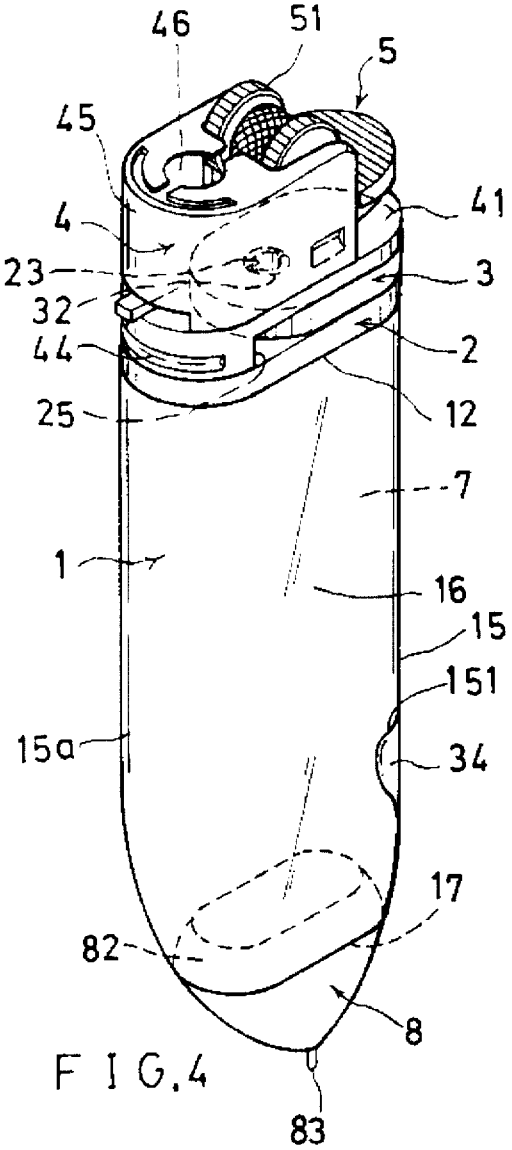
FIG. 4 is a perspective view of the present invention when folding the clip member.
Figure 5:
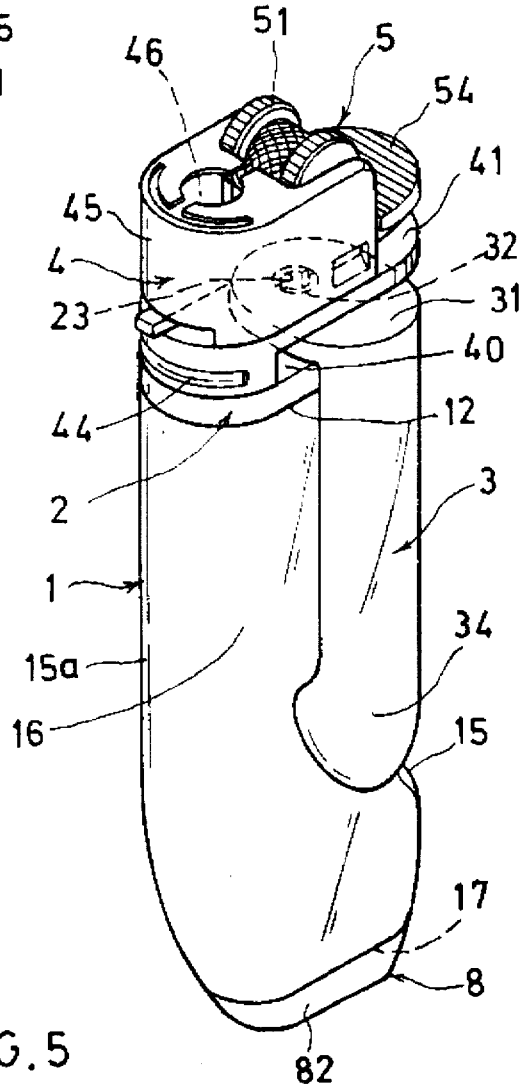
FIG. 5 is an illustration of the present invention showing an extended clip member ready for clamping purpose.

For ignition use, the clip member 3 may be pivoted to rest the clip portion 34 in the socket 151 of the first convex side wall 15 of the lighter body 1 as shown in FIG. 4 for a smooth ergonomic holding of the lighter body 1 when igniting a cigarette by the gas lighter.

Figure 3:
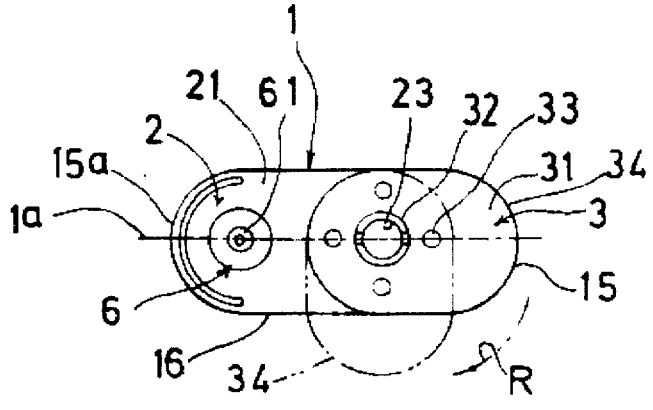
FIG. 3 is a top view illustration showing a pivotal movement of the clip member of the present invention.

If not for ignition use, the clip member 2 may be pivoted about the shaft portion 23 to rotate (R) the clip portion 34 in clockwise direction as shown in FIG. 3 from the first convex side wall 15 to the flat side wall 16 for clamping the clip portion 34 and the gas lighter on a user's pocket or other suitable location for an easy finding of the lighter ready for an ignition use.

The pen means 1 may be oriented to allow the writing portion 83 to protrude downwardly (FIG. 6) for writing; and may also be inverted to receive the holding portion 81 into the cavity 17 and to insert the writing portion 83 into the tip socket 171 (FIG. 7) for storing the pen means 8 in the lighter.

The present invention provides a gas lighter adapted for pocket clipping when extending the clip member 2; or for a smooth holding of the lighter body upon folding of the clip member 2 when igniting a cigarette. Even though the accompanying drawing figures illustrate a flint type igniting means 5, however an electronic igniting mechanism may also be used in accordance with the present invention.

I claim:

1. A gas lighter comprising:

a lighter body having a fuel container filled with fuel therein and having at least a convex side wall and a flat side wall disposed on said lighter body;

a packing member secured on an upper cover of the lighter body and having a shaft portion protruding upwardly from the packing member;

a top frame having an igniting means mounted thereon and secured on the packing member for igniting use, with a rotating space defined between said top frame and said packing member; and a clip member rotatably mounted on said shaft portion and normally rested on the convex side wall of said lighter body for forming a smooth outer surface of said clip member and said lighter body for holding lighter body and the clip member for ignition use; and upon a pivotal movement of the clip member in the rotating space about said shaft portion to be positioned beyond the flat side wall of the lighter body, the clip member will be clamped on a user's pocket for storing purpose.

2. A gas lighter according to claim 1, wherein said lighter body includes: said fuel container having a cross section generally formed as elliptical shape defining a transverse axis and a conjugate axis; a first and a second convex side wall disposed on two opposite ends of the transverse axis; two flat side walls disposed on two opposite ends of the conjugate axis; said upper cover formed on an upper portion of the container having a stem opening recessed in a middle portion of the upper cover for engaging the packing member; and a valve opening formed in an end portion of said upper cover adjacent to the second convex side wall for securing a valve means therein.

3. A gas lighter according to claim 2, wherein said packing member includes: a base plate generally formed as an elliptical shape coincided with the cross section of the fuel container of the lighter body, a hollow stem protruding downwardly from the base plate and engaged with the stem opening recessed in the upper cover of the lighter body, a shaft portion protruding upwardly from the base plate for rotatably mounting the clip member and having a central opening recessed in the shaft portion for engaging the top frame with the shaft portion aligned with the hollow stem, a receiving extension protruding upwardly from an edge portion of the base plate adjacent to the second convex side wall of the lighter body, and a valve opening formed through the base plate adjacent to the receiving extension and distal from the first convex side wall of the lighter body for passing the valve means through the valve opening of the packing member.

4. A gas lighter according to claim 3, wherein said clip member includes: a rotating disk generally formed as an elliptical shape and having an inner end portion adjacent to the valve means which is secured in the packing member and protruded upwardly into the top frame, a shaft hole formed in the inner end portion of the disk and engaged with the shaft portion of the packing member, and a clip portion protruding downwardly from the outer end portion of the disk and normally rested on the first convex side wall of the lighter body to be engageable with a clip socket recessed in the first convex side wall for forming a smooth arcuate outer surface of the clip portion and the first convex side wall of the lighter body.

5. A gas lighter according to claim 4, wherein said top frame includes: a platform formed as an elliptical shape to be projectively coincided with the packing member and an upper cover of the lighter body, a flint pipe protruding downwardly from the platform to be filled with a flint of an igniting means in the flint pipe and engaged with a central opening recessed in said packing member, an engaging extension protruding downwardly from an edge portion of the platform to be coupled with a receiving extension formed on the packing member, a wind shield protruding upwardly from the platform for surrounding a gas nozzle of the valve means fixed in an ignition chamber defined within the wind shield, and a rotating space defined between a bottom surface of the platform and a base plate of the packing member for rotatably mounting the rotating disk of the clip member within the rotating space.

6. A gas lighter according to claim 5, wherein said platform of the top frame is formed with a plurality of recesses annularly disposed around the flint pipe on a bottom surface of the platform to be engageable with a plurality of protrusions annularly disposed around a shaft hole in the rotating disk of the clip member for stably engaging the clip member with the top frame when pivoting the clip member about the shaft portion of the packing member on the lighter body.

7. A gas lighter according to claim 6, wherein said flint pipe is formed with two lugs engageable with a pair of slots diametrically slotted on the shaft portion for preventing a twisting of the flint pipe in the central opening of the shaft portion.

8. A gas lighter according to claim 1, wherein said lighter body has a bottom cavity recessed in a bottom of the lighter body for receiving a pen means in the bottom cavity, and upon holding of the pen means on the bottom cavity, the pen means will be protruded downwardly from the bottom of said lighter body for writing purpose.

9. A gas lighter according to claim 8, wherein said pen means includes: said writing portion fixed on a holding portion generally formed as a cone shape and engageable with the bottom cavity which is formed as a cone shape concave and tapered upwardly in the lighter body when receiving the pen means in the bottom cavity, a tip socket recessed upwardly from a central inner portion of the bottom cavity for receiving the writing portion for storing the pen means in said bottom cavity, and a truncated base generally formed as a truncated cone shape tapered in a direction opposite to a tapering direction of the holding portion and engageable with the bottom cavity for stably embedding the truncated base in the bottom cavity for protruding the holding portion and the writing portion downwardly for writing purpose.

10. A gas lighter comprising: a lighter body having a fuel container filled with fuel therein and having at least a convex side wall and a flat side wall disposed on said lighter body; a shaft portion protruding upwardly from an upper cover of said a top frame having an igniting means mounted thereon and secured on the upper cover for igniting use, with a rotating space defined between said top frame and said upper cover of said lighter body; and a clip member rotatably mounted on said shaft portion and normally rested on the convex side wall of said lighter body for forming a smooth outer surface of said clip member and said lighter body for holding said lighter body and the clip member for ignition use; and upon a pivotal movement of the clip member in the rotating space about said shaft portion to be positioned beyond the flat side wall of the lighter body, the clip member will be clamped on a user's pocket for storing purpose.

* * * * *